US010815797B2

(12) United States Patent
Karlen et al.

(10) Patent No.: US 10,815,797 B2
(45) Date of Patent: Oct. 27, 2020

(54) AIRFOIL SYSTEMS AND METHODS OF ASSEMBLY

(71) Applicant: Hamilton Sundstrand Corporation, Charlotte, NC (US)

(72) Inventors: Eric Karlen, Rockford, IL (US); William L. Wentland, Rockford, IL (US); Daniel O. Ursenbach, Caledonia, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 699 days.

(21) Appl. No.: 15/235,291

(22) Filed: Aug. 12, 2016

(65) Prior Publication Data

US 2018/0045216 A1 Feb. 15, 2018

(51) Int. Cl.

| | |
|---|---|
| ***F01D 5/28*** | (2006.01) |
| ***F04D 29/02*** | (2006.01) |
| ***F04D 29/32*** | (2006.01) |
| ***F04D 29/38*** | (2006.01) |
| ***F04D 29/54*** | (2006.01) |
| ***F04D 29/64*** | (2006.01) |

(52) U.S. Cl.

CPC ..... *F01D 5/288* (2013.01); *F01D 5/28* (2013.01); *F01D 5/282* (2013.01); *F01D 5/284* (2013.01); *F01D 5/286* (2013.01); *F04D 29/023* (2013.01); *F04D 29/325* (2013.01); *F04D 29/388* (2013.01); *F04D 29/542* (2013.01); *F04D 29/644* (2013.01); *F05D 2230/30* (2013.01); *F05D 2230/312* (2013.01)

(58) Field of Classification Search

None

See application file for complete search history.

(56) References Cited

U.S. PATENT DOCUMENTS 2,431,184 A * 11/1947 Martin ..... 416/224
8,075,274 B2 12/2011 Carvalho (Continued)

FOREIGN PATENT DOCUMENTS

EP 2530063 A2 12/2012
EP 2631323 A1 8/2013

(Continued)

OTHER PUBLICATIONS

Extended European Search report dated Dec. 12, 2017, issued during the prosecution of European Patent Application No. 17185775.8 (9 pages).

*Primary Examiner* — Igor Kershteyn
*Assistant Examiner* — Juan G Flores
(74) *Attorney, Agent, or Firm* — Locke Lord LLP; Scott D. Wofsy; Alicia J. Carroll

(57) ABSTRACT

An airfoil assembly includes an airfoil body extending from a root to a tip defining a longitudinal axis therebetween. The airfoil body includes a leading edge between the root and the tip. A sheath is direct deposited on the airfoil body. The sheath includes at least one metallic material layer conforming to a surface of the airfoil body. In accordance with another aspect, a method for assembling an airfoil assembly includes directly depositing a plurality of material layers on an airfoil body to form a sheath. In accordance with some embodiments, the method includes partially curing the airfoil body.

8 Claims, 3 Drawing Sheets

(56) References Cited

U.S. PATENT DOCUMENTS

| | | | | |
|---|---|---|---|---|
| 8,240,046 | B2 | 8/2012 | Peretti et al. | |
| 8,449,784 | B2 | 5/2013 | Parkos et al. | |
| 8,851,421 | B2 * | 10/2014 | Jevons | F01D 5/282 244/123.1 |
| 9,140,130 | B2 | 9/2015 | Mironets et al. | |
| 9,157,327 | B2 | 10/2015 | Deal et al. | |
| 9,279,328 | B2 | 3/2016 | Roy et al. | |
| 2006/0018760 | A1 | 1/2006 | Bruce et al. | |
| 2009/0074586 | A1 | 3/2009 | Le Hong et al. | |
| 2011/0097213 | A1 | 4/2011 | Peretti et al. | |
| 2011/0116906 | A1 * | 5/2011 | Smith | B64C 11/205 415/1 |
| 2011/0129600 | A1 * | 6/2011 | Das | C23C 24/04 427/201 |
| 2011/0194941 | A1 | 8/2011 | Parkin et al. | |
| 2011/0211967 | A1 | 9/2011 | Deal et al. | |
| 2012/0082559 | A1 | 4/2012 | Guglielmin et al. | |
| 2012/0096714 | A1 * | 4/2012 | Bishop | C23C 4/02 29/889.1 |
| 2012/0301292 | A1 | 11/2012 | Deal et al. | |
| 2013/0001837 | A1 | 1/2013 | Gohler et al. | |
| 2013/0111908 | A1 | 5/2013 | Murooka et al. | |
| 2013/0199934 | A1 | 8/2013 | Parkos, Jr. et al. | |
| 2014/0170435 | A1 | 6/2014 | Hui et al. | |
| 2015/0064015 | A1 | 3/2015 | Perez | |
| 2015/0064016 | A1 | 3/2015 | Cortequisse | |
| 2015/0104325 | A1 | 4/2015 | Yagi et al. | |
| 2015/0184306 | A1 | 7/2015 | Parkos, Jr. et al. | |
| 2015/0218953 | A1 * | 8/2015 | Bottome | F01D 5/147 416/224 |
| 2015/0354375 | A1 | 12/2015 | McComb | |
| 2015/0377030 | A1 | 12/2015 | Murdock | |
| 2016/0001407 | A1 | 1/2016 | Hansen et al. | |
| 2016/0032738 | A1 | 2/2016 | Ding | |
| 2016/0151860 | A1 | 6/2016 | Engeli et al. | |

FOREIGN PATENT DOCUMENTS

| | | | |
|---|---|---|---|
| WO | WO-2014022039 | A1 | 2/2014 |
| WO | WO-2014031195 | A1 | 2/2014 |
| WO | WO-2015025598 | A1 | 2/2015 |
| WO | WO-2015034612 | A1 | 3/2015 |
| WO | WO-2015047752 | A1 | 4/2015 |
| WO | WO-2015047754 | A1 | 4/2015 |
| WO | WO-2015047949 | A1 | 4/2015 |
| WO | WO-2015069344 | A1 | 5/2015 |
| WO | WO-2015155905 | A1 | 10/2015 |
| WO | WO-2016019468 | A1 | 2/2016 |

* cited by examiner

AIRFOIL SYSTEMS AND METHODS OF ASSEMBLY

BACKGROUND OF THE INVENTION

1. Field of the Invention

The present disclosure relates to airfoils and manufacturing of airfoils, and more particularly to sheaths for composite airfoils.

2. Description of Related Art

Some aerospace components, such as a fan blade body and a blade sheath and/or a blade cover, are assembled using an adhesive to bond the components together. The blade sheath is traditionally a machined metallic structure that is bonded to the blade. Bonding the blade sheath onto the blade can be time consuming and not conducive to lean manufacturing principles such as one-piece-flow. Moreover, fit-up between the blade and the sheath is a precise and time consuming process due to manufacturing tolerances between the sheath structure and the blade.

Such conventional methods and systems have generally been considered satisfactory for their intended purpose. However, there is still a need in the art for improved airfoils and methods for manufacturing for airfoils.

SUMMARY OF THE INVENTION

An airfoil assembly includes an airfoil body extending from a root to a tip defining a longitudinal axis therebetween. The airfoil body includes a leading edge between the root and the tip. A sheath is direct deposited on the airfoil body. The sheath includes at least one metallic material layer conforming to a surface of the airfoil body.

In accordance with some embodiments, the sheath is direct deposited on the leading edge of the airfoil body. The airfoil body can include a composite material. The sheath can define an internal pocket that includes a lattice structure. The sheath can include at least one of a composite or fiberglass structure bonded in between layers of the sheath. The sheath can include a plurality of layers. It is contemplated that the layers can be alternating material layers or groups of layers with alternating materials. An exterior layer can include a material of a higher erosion resistance than an interior layer. A first layer in direct contact with the airfoil body can include a material having a lower deposition temperature than layers exterior to the first layer.

In accordance with another aspect, a method for assembling an airfoil assembly includes directly depositing at least one material layer on an airfoil body to form a sheath. In accordance with some embodiments, the method includes partially curing the airfoil body. The at least one material layer can be one of a plurality of material layers. The method can include ball milling at least one of the material layers prior to depositing an adjacent one of the material layers. Directly depositing the at least one material layer can include directly depositing at least one of material layers of alternating materials, or groups of material layers of alternating materials. The method can include bonding at least one of a composite or fiberglass structure between adjacent material layers of the sheath. Directly depositing the material layer on the airfoil body can include depositing the material layer using a micro plasma spray process.

These and other features of the systems and methods of the subject disclosure will become more readily apparent to those skilled in the art from the following detailed description of the embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE EMBODIMENTS

Figure 1:
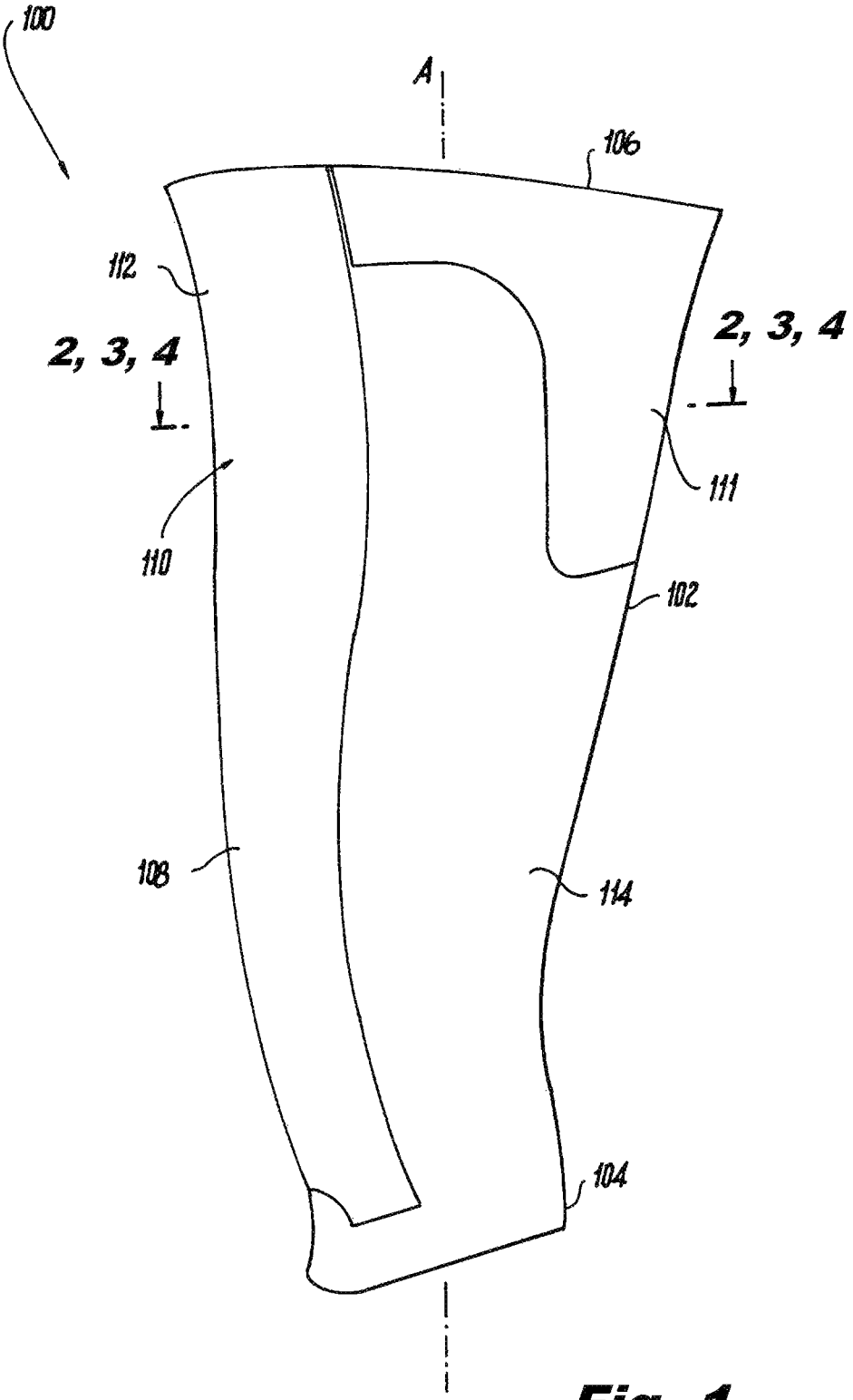
FIG. 1 is a perspective view of an exemplary embodiment of a fan blade in accordance with the present disclosure, showing a leading edge sheath and a trailing edge/tip sheath directly deposited on the fan blade.

Reference will now be made to the drawings wherein like reference numerals identify similar structural features or aspects of the subject disclosure. For purposes of explanation and illustration, and not limitation, an exemplary embodiment of an airfoil assembly constructed in accordance with the disclosure is shown in FIG. 1 and is designated generally by reference character 100. Other embodiments of airfoil systems and methods for assembly in accordance with the disclosure, or aspects thereof, are provided in FIGS. 2-5, as will be described. The systems and methods described herein can be used to improve bonding between the airfoil body and the airfoil sheath and provide increased efficiency and consistency in manufacturing.

As shown in FIG. 1, an airfoil assembly 100 includes an airfoil body 102, e.g. a fan blade body, extending from a root 104 to a tip 106 defining a longitudinal axis A therebetween. The airfoil body 102 includes a leading edge 108 between root 104 and tip 106. Airfoil body 102 is made from a composite material. A sheath 110 is direct deposited on leading edge 108 of airfoil body 102, without adhesive deposited therebetween. Depositing metallic sheath 110 creates a conformal sheath 110 that fits better than traditional sheaths with airfoil body 102. It also eliminates traditional supplemental processing of airfoil body 102, such as adhesive bonding of the sheath to the airfoil body and the surface preparation processes associated with the bonding operation.

Sheath 110 is deposited using a micro plasma spray process, for example the services and technology, available from MesoScribe Technologies, Inc., 7 Flowerfield, Suite 28, St. James, N.Y., or the like. Using this process tends to minimize heat input allowing for direct deposition of a metallic structure onto a non-metallic substrate (e.g. composite airfoil body 102). Direct deposition allows for the deposited sheath 110 to be tailored for the application, as described in more detail below. It is also contemplated that sheath 110 can be deposited using a directed energy deposition or cold spray deposition processes.

With continued reference to FIG. 1, sheath 110 includes at least one metallic material layer 112 conforming to a surface 114 of airfoil body 102. Airfoil assembly 100 also includes a trailing edge/tip sheath 111. It is contemplated that sheath 110 can be used with or without trailing edge/tip sheath 111, and vice versa. Trailing edge/tip sheath 111 is similar to sheath 110 in that it also is direct deposited, can include one or more layers, and can include one or more of the various features described below with respect to sheath 110.

Figure 2:
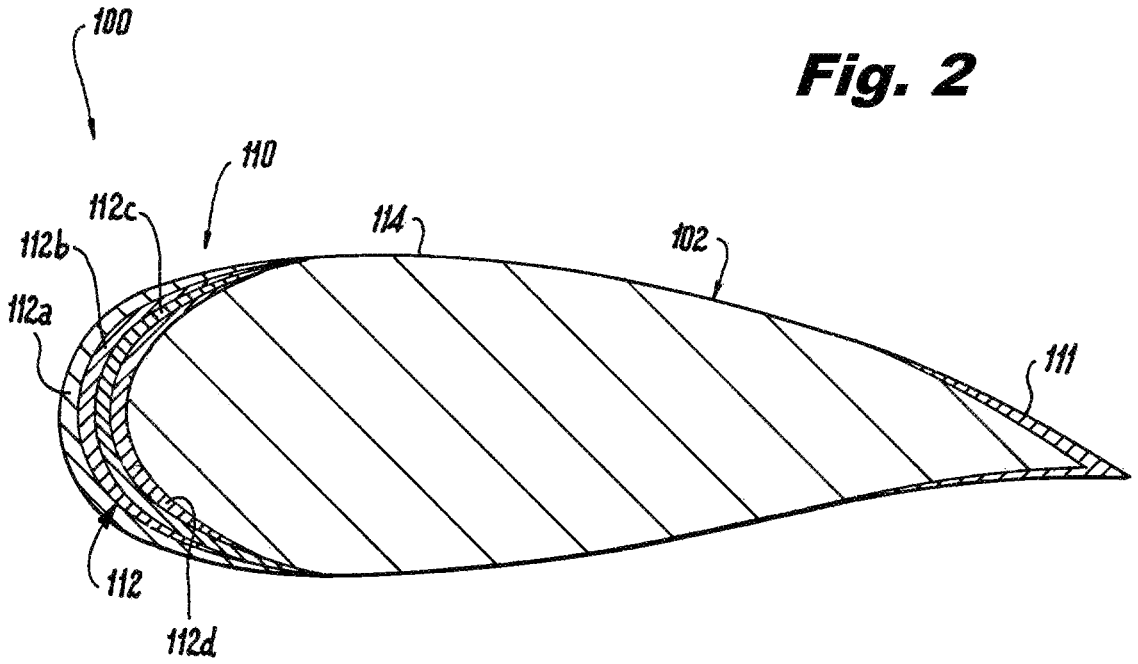
FIG. 2 is a schematic cross-sectional view of the fan blade of FIG. 1, schematically showing the material layers in the leading edge sheath.

With reference now to FIG. 2, sheath 110 includes a plurality of layers 112. Layers 112 can be alternating material layers or groups of layers with alternating materials. In accordance with some embodiments, alternating layers 112 of more ductile materials (e.g. Cu, Al, and/or alloys thereof) are applied with higher strength materials (e.g. Ni, Ti, and/or alloys thereof). For example, interior layer 112*b* can be a copper alloy and second interior layer 112*c* can be a titanium alloy. An exterior layer 112*a* can include a material of a higher erosion resistance than an interior layer 112*b*. For example, material for exterior layer 112*a* can have higher erosion resistance characteristics like that of Nickel, tungsten and/or cermet (composite material composed of ceramic (cer) and metallic (met) materials), as compared with a lighter material like titanium/titanium alloy. Thin layers of a material with greater erosion resistance such as cobalt, tungsten, or their alloys as well as cermet material can also be added. The use of materials with greater erosion resistance in certain layers assists in further reducing weight as it permits sheath 110 to only include nickel/nickel alloy material, cermet, cobalt, tungsten, or their alloys where erosion resistance is required, instead of fabricating the entire sheath 110 from those materials.

With continued reference to FIG. 2, a first layer 112*d* in direct contact with the airfoil body 102 includes a material having a lower deposition temperature than layers exterior to first layer 112*d*, e.g. exterior layer 112*a*. This tends to improve adhesion of metallic material layer 112*d* to composite surface 114 of airfoil body 102.

Figure 3:
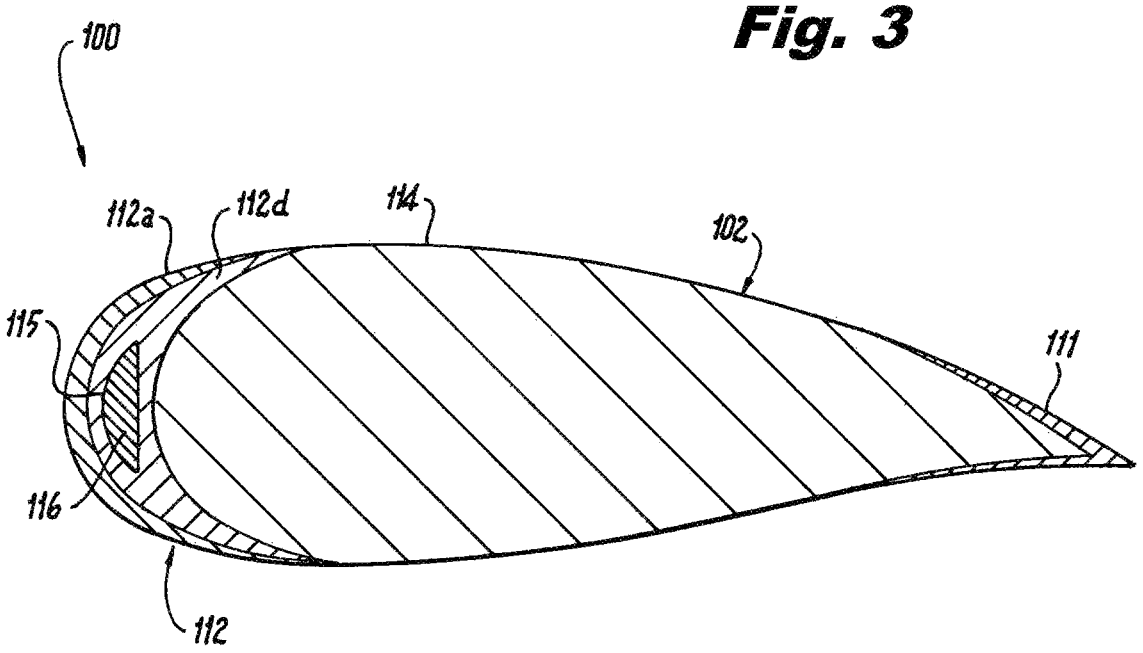
FIG. 3 is a schematic cross-sectional view of another exemplary embodiment of a fan blade in accordance with the present disclosure, schematically showing a lattice structure in between material layers in a leading edge sheath.
Figure 4:
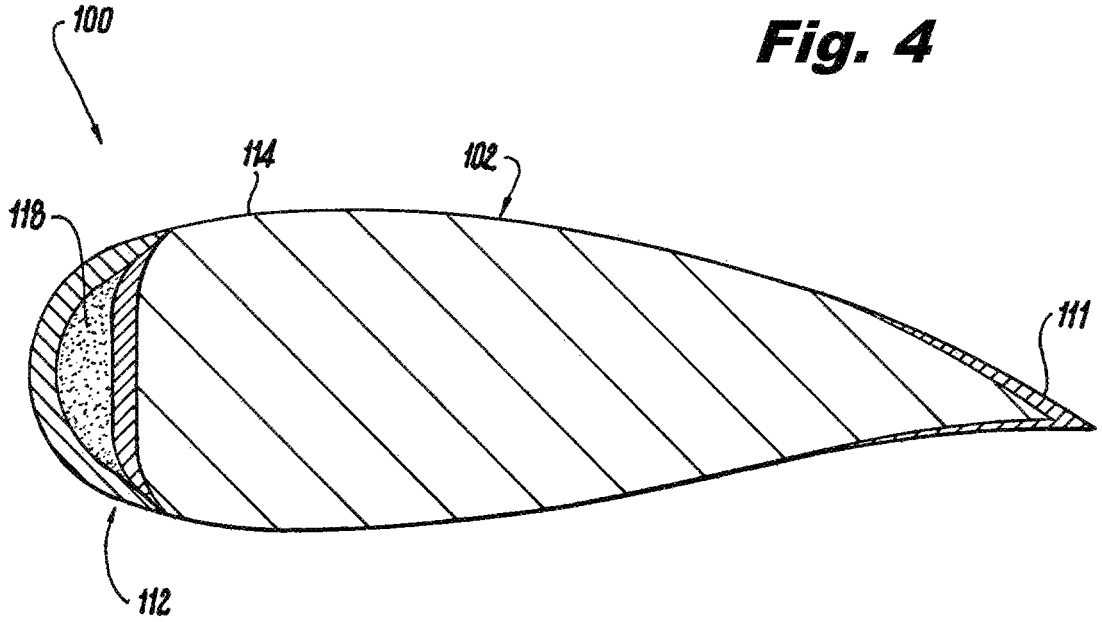
FIG. 4 is a schematic cross-sectional view of another exemplary embodiment of a fan blade in accordance with the present disclosure, schematically showing a light-weight filler material bonded in between material layers in a leading edge sheath.

As shown in FIGS. 3 and 4, sheath 110 includes a structure that is tailored to reduce weight in sheath 110. For example, as shown in FIG. 3, sheath 110 defines an internal pocket 115 that includes a lattice structure 116. In FIG. 3, lattice structure 116 is shown embedded within first layer 112*d*. It is also contemplated that lattice structure 116 can cross between multiple material layers 112 instead of being formed within first layer 112*d*. First layer 112*d*, in FIG. 3, can be a titanium or titanium alloy material. Lattice structure 116 is also fabricated using one or more of the direct deposition techniques listed above. It is contemplated that lattice structure 116 can be fabricated from the same material as first layer 112*d* or a different material. Lattice structure 116 tends to improve toughness by better absorbing energy from an impact event. As shown in FIG. 4, sheath 110 includes a light weight filler material, e.g. a composite and/or fiberglass structure 118, bonded in between layers 112 of sheath 110. Lattice structure 116 and light weight filler material 118 can extend substantially all of the axial length of sheath 110 or they can be oriented in only part of sheath 110, e.g. defined in spaced apart portions along sheath 110.

Figure 5:
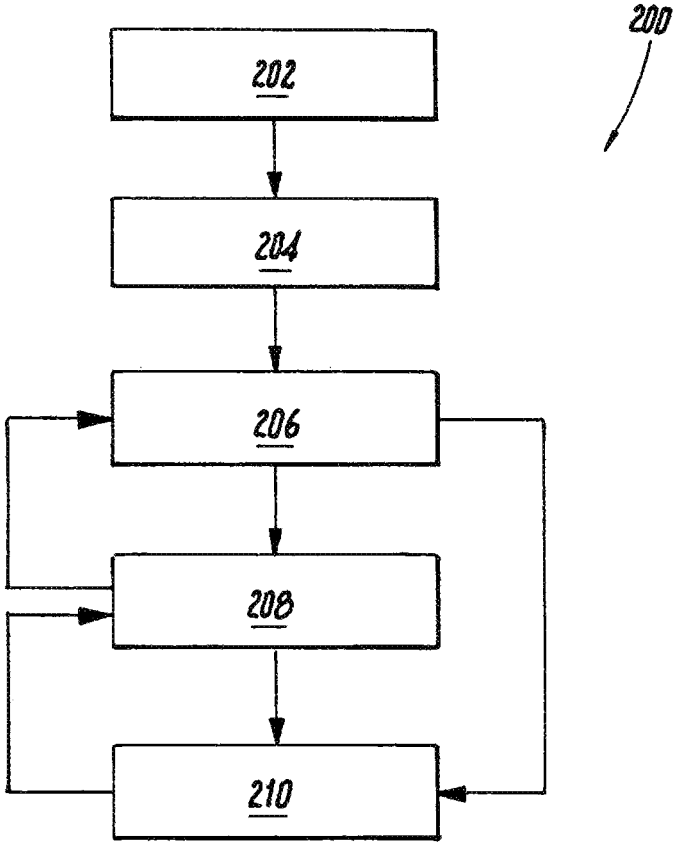
FIG. 5 is a flow chart schematically depicting a method for assembling an airfoil assembly in accordance with the present disclosure.

As shown in FIG. 5, a method 200 for assembling an airfoil assembly includes partially curing an airfoil body, e.g. airfoil body 102, as indicated schematically by box 202. Method 200 includes directly depositing a material layer, e.g. material layer 112, on the airfoil body to form an at least partially metallic sheath, e.g. sheath 110, as indicated schematically by box 204. It is also contemplated that the sheath can be a metallic-composite sheath. Directly depositing the material layer can include directly depositing material layers of alternating materials, or groups of material layers of alternating materials. Directly depositing the material layer on the airfoil body includes depositing the material layer using a micro plasma spray process. After depositing one or more material layers, method 200 includes ball milling the last deposited material layer or group of layers, as indicated schematically by box 206, prior to depositing an adjacent one of the material layers or group of layers, as indicated by box 208. In other words, method 200 includes ball milling the layers or groups of layers between each deposition. Ball milling to deform the deposited material tends to increase compression in the deposited metal, thereby increasing dislocation density within the metallic substrate, and thereby increasing the driving force to drive dynamic recrystallization. Recrystallization tends to improve ductility by nucleating new grains and allow them to grow during the deposition manufacturing process.

Deposition of subsequent layers should provide the heat input necessary to the metallic substrate causing dynamic recrystallization to occur. Those skilled in the art will readily appreciate that nickel and/or nickel alloy and aluminum materials tend to be better suited for this due to the higher achievable stacking fault energies from work hardening during ball milling. Higher stacking fault energies would require lower temperatures to initiate recrystallization. Method 200 includes bonding a composite or fiberglass structure, e.g. composite or fiberglass structure 118, between adjacent material layers of the sheath, and/or forming a lattice structure, e.g. lattice structure 116, as indicated schematically by box 210.

While shown and described in the exemplary context of composite fan blades, those skilled in the art will readily appreciate that the systems and methods described herein can be used on any other airfoils (metallic, composite or otherwise) without departing from the scope of this disclosure. For example, the embodiments described herein can readily be applied to other airfoil assemblies, such as, inlet guide vanes, propeller blades or the like. Embodiments of the systems and methods described herein will reduce the manufacturing lead time for composite fan blades and other airfoils and provides for the ability to tailor the characteristics of the sheath for a given application. The process is less wasteful than traditional machining of sheaths, as material is being deposited only where it is needed.

The methods and systems of the present disclosure, as described above and shown in the drawings, provide for improved systems and methods for fabricating an airfoil assembly. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. An airfoil assembly comprising:

an airfoil body extending from a root to a tip defining a longitudinal axis therebetween, wherein the airfoil body includes a leading edge between the root and the tip; and a sheath direct deposited on the airfoil body, wherein the sheath includes at least one metallic material layer conforming to a surface of the airfoil body, wherein the sheath defines an internal pocket surrounded by the sheath, wherein at least a portion of the sheath is between the internal pocket and the leading edge of the airfoil body, wherein the at least one metallic material layer surrounds the internal pocket, and wherein the internal pocket includes a lattice structure that is surrounded by the at least one metallic material layer.

2. An airfoil as recited in claim 1, wherein the sheath is direct deposited on the leading edge of the airfoil body.

3. An airfoil as recited in claim 1, wherein the airfoil body includes a composite material.

4. An airfoil as recited in claim 1, wherein the sheath includes a plurality of layers, wherein at least one of a composite or fiberglass structure is bonded in between layers of the sheath.

5. An airfoil as recited in claim 1, wherein the sheath includes a plurality of layers.

6. An airfoil as recited in claim 5, wherein the layers are alternating material layers.

7. An airfoil as recited in claim 5, wherein an exterior layer includes a material of a higher erosion resistance than an interior layer.

8. An airfoil as recited in claim 5, wherein a first layer in direct contact with the airfoil body includes a material having a lower deposition temperature than layers exterior to the first layer.

* * * * *